US005517907A

United States Patent [19]

Fox

[11] Patent Number: 5,517,907

[45] Date of Patent: May 21, 1996

[54] REFUSE COMPACTOR WITH FOLDING COMPACTION PLATE

[75] Inventor: Anthony Fox, Bloomington, Minn.

[73] Assignee: TFC Corporation, Minneapolis, Minn.

[21] Appl. No.: 341,008

[22] Filed: Nov. 17, 1994

[51] Int. Cl.[6] ..... B30B 15/06

[52] U.S. Cl. ..... 100/53; 100/229 A; 100/233; 220/908

[58] Field of Search ..... 100/53, 102, 229 A, 100/233; 220/908

[56] References Cited

U.S. PATENT DOCUMENTS

| | | | |
|---|---|---|---|
| 3,838,635 | 10/1974 | Hardy | 100/229 A |
| 4,147,100 | 4/1979 | Dykstra | 100/229 A |
| 4,152,035 | 5/1979 | Fox | 100/229 A |
| 4,188,872 | 2/1980 | Chrablow | 100/233 |
| 4,552,061 | 11/1985 | Brutsman | 100/229 A |
| 4,609,122 | 9/1986 | Ziegenbein | 220/211 |
| 4,765,548 | 8/1988 | Sing | 220/908 |
| 4,870,898 | 10/1989 | Spencer | 100/233 |

*Primary Examiner*—Stephen F. Gerrity
*Attorney, Agent, or Firm*—Haugen and Nikolai

[57] ABSTRACT

A refuse compactor especially designed for fast food restaurants is of a predetermined limited height dimension allowing its upper surface to function as a serving tray storage rack. The refuse compactor is characterized by having a foldable compaction plate driven by a hydraulic ram. When the compaction plate is elevated to its uppermost position, it is folded in a way that does not interfere with the opening of the refuse entry door. When moving through its compaction stroke, the foldable compaction plate becomes locked in a flat, planar configuration. In this way, it is unnecessary to locate the compaction plate above the refuse entry door, thereby providing a lower profile to the refuse compactor cabinet.

22 Claims, 8 Drawing Sheets

REFUSE COMPACTOR WITH FOLDING COMPACTION PLATE

BACKGROUND OF THE INVENTION

1. Field of the Invention

This invention relates generally to refuse compacting machines, and more particularly to refuse compacting machines especially designed for reducing the volume of refuse generated in fast food restaurant and similar applications.

2. Discussion of the Prior Art

Most fast food restaurants provide trash receptacles near their exit doors where patrons are expected to deposit the boxes, paper glasses, wrappers, napkins, placemats, etc. which are provided at the time that the food items are served. These trash receptacles typically comprise a wood, metal or plastic cabinet in the form of a rectangular parallelepiped and contained within the cabinet is a structure for supporting a polyethylene trash bag so that the open mouth thereof spans the internal dimensions of the trash receptacle beneath a refuse entry door. Patrons, upon leaving the restaurant, will dump the contents of a serving tray through the refuse entry door and then will place the serving tray atop the trash receptacle for storage until employee personnel remove them for cleaning and reuse.

Because the waste paper and food products are not compacted in any way upon being deposited into the prior art trash receptacle, the trash receptacles have to be emptied frequently and new trash bags inserted. This is not only labor intensive but also requires a large storage area where the filled bags of trash can be stored until a commercial pick-up service comes into remove them. Moreover, most commercial refuse collection services charge on a volume basis rather than a weight basis.

Refuse compactors are well known in the art. They generally comprise a cabinet having a compaction chamber at the base thereof and disposed above the compaction chamber is a hydraulically-driven, reciprocally moveable compaction plate. The cabinet includes a refuse entry door that necessarily must be positioned beneath the topmost position assumed by the compaction plate. When refuse is deposited through the refuse entry door, it falls into the compaction chamber. Upon actuation of the hydraulically operated compaction plate, it descends from its topmost position into the compaction chamber to compress the refuse present therein. Typical of such a prior art refuse compactor is that described in the Fox et al. U.S. Pat. No. 5,012,732, which is assigned to applicant's assignee.

Because of the space necessarily occupied by the hydraulic motor, hydraulic pump and hydraulic ram used to drive the compaction plate must be above the level of the refuse entry door, in the past a refuse compactor typically would be up to 70 inches in height, i.e., about the size of a typical household refrigerator. A refuse compactor of this size has been determined to be impractical for fast food restaurant applications in that it is impractical for tray storage.

It is accordingly a principal object of the present invention to provide an improved refuse compactor suitable for fast food restaurant and like applications.

Another object of the invention is to provide a refuse compactor whose height profile is dramatically reduced.

It is a further object of the invention to provide a refuse compactor providing an optimal volume and weight of compressed refuse while still maintaining a low height profile to the compactor cabinet.

It is a still further object of the invention to provide a refuse compactor that is safe for use by members of the public in disposing of fast food restaurant packaging materials.

SUMMARY OF THE INVENTION

The foregoing features and objects of the invention are achieved by providing a refuse compactor of the type having a cabinet with a refuse entry door swingably mounted therein for pivotal movement to an open position about a first horizontal axis, along with a reciprocally moveable compaction plate that is disposed in the cabinet for vertical movement between an elevated position proximate the refuse entry door to a refuse compacting position located below the refuse entry door. The compaction plate of the present invention comprises first and second planar segments that are hinged together about a second horizontal axis. One of the two compaction plate segments is affixed to a means for driving the compaction plate between the elevated position and the refuse compacting position. Disposed in the path of travel of the compaction plate is a device for unfolding and locking the first and second planar segments in a planar orientation as the compaction plate moves from its elevated position to its refuse compacting position and to fold the compaction plate so that the segments thereof are at a predetermined acute angle as the compaction plate moves from its refuse compacting position back to its elevated position. In this fashion, the refuse entry door is not blocked by the compaction plate and can be opened to allow the deposit of trash into the compaction chamber even though the compaction plate is at an elevation that is adjacent the refuse entry door.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which.

DETAILED DESCRIPTION OF THE PREFERRED EMBODIMENT

Figure 1:
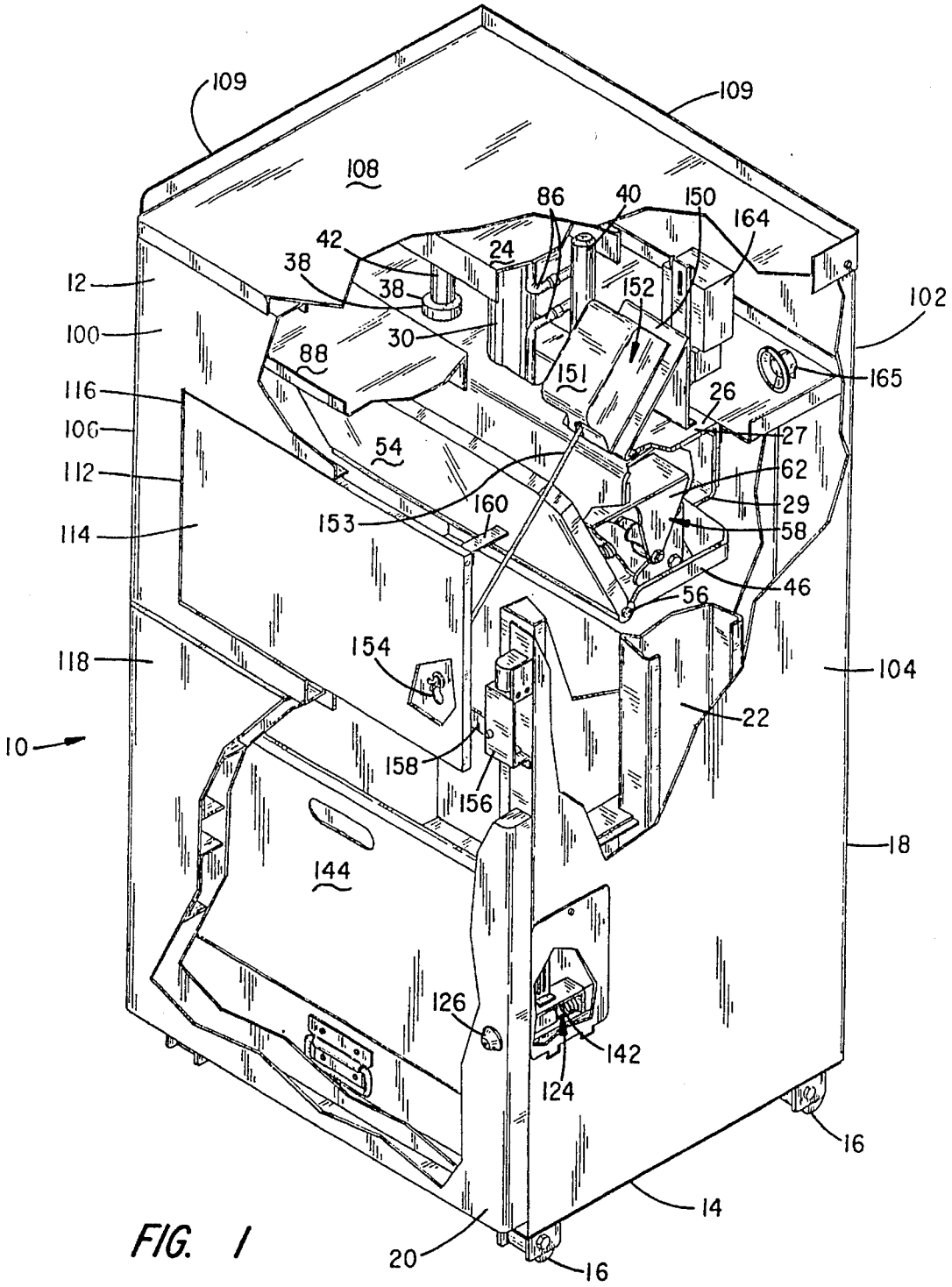
FIG. 1 is a perspective drawing of a refuse compactor in accordance with the present invention, partially broken away to show the compaction plate thereof in its elevated, folded condition.

Referring first to FIG. 1, there is indicated generally by numeral 10 a refuse compactor in accordance with the present invention. It is seen to comprise a cabinet 12 of generally rectangular parallelepiped shape. Without limitation, its dimensions are preferably about 24 inches wide, 24 inches deep and 48 inches high. It comprises an inner frame, including a generally rectangular base 14 comprising a box-like structure containing reinforcing channels (not shown) capable of withstanding any bending forces that are applied as the compaction operation takes place. The base 14 is preferably mounted on caster wheels as at 16 located at the four corners of the cabinet to allow it to be readily moved.

Welded or otherwise affixed to the base 14 midway between the back surface 18 of the cabinet 12 and its front surface 20 and proximate the right and left sides thereof are vertically extending steel channels as at 22 which support a horizontally extending top channel 24. Extending between and welded to the vertically extending side channels 22 is a cross arm 26 comprising first and second tampered steel U-channels 27 and 29 which, when assembled together as shown in FIG. 1, form an extremely rigid, strong cross arm assembly.

Figure 2:
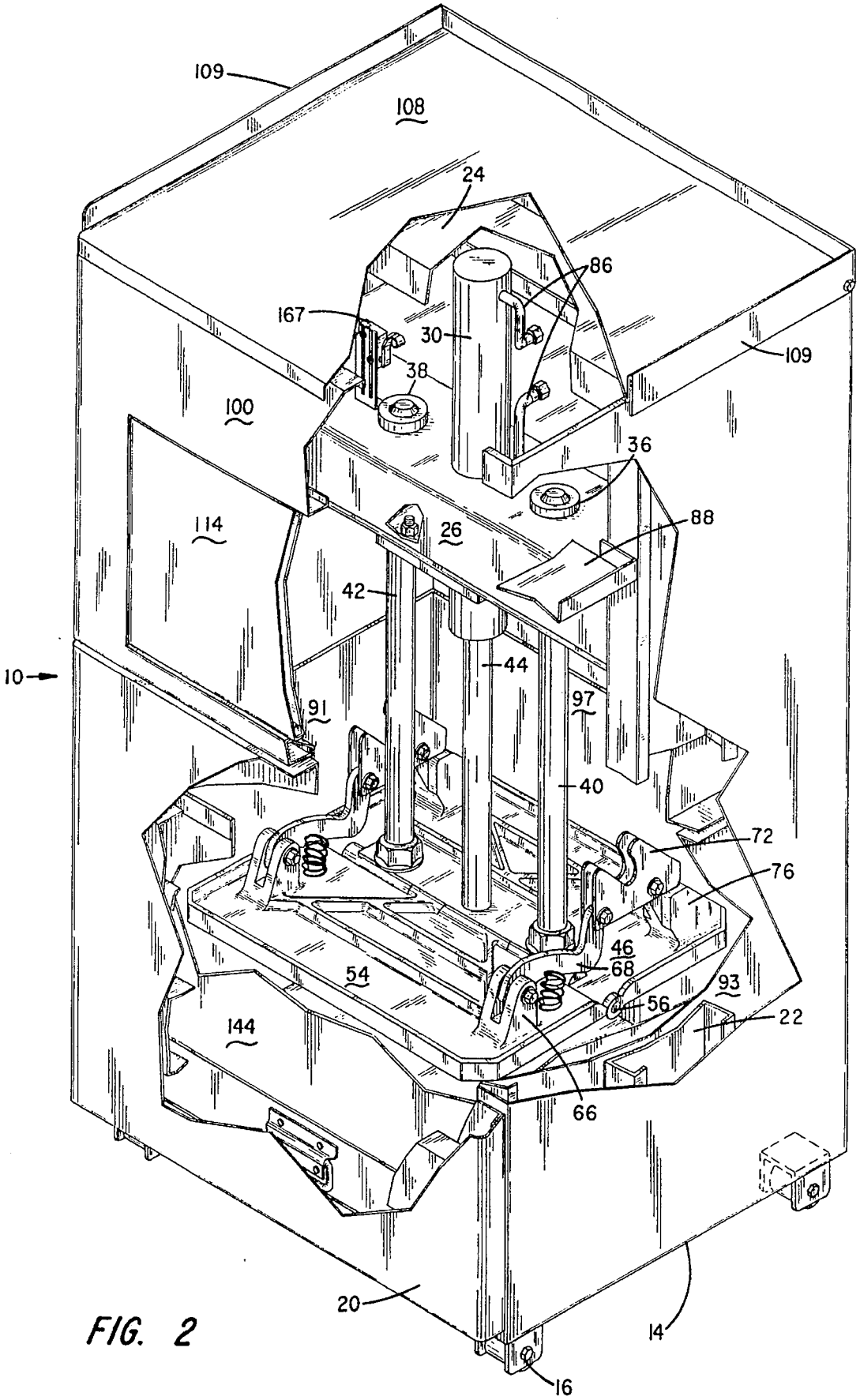
FIG. 2 is a perspective drawing similar to that of FIG. 1 but showing the compaction plate of the refuse compactor in its lower, planar configuration.
Figure 3:
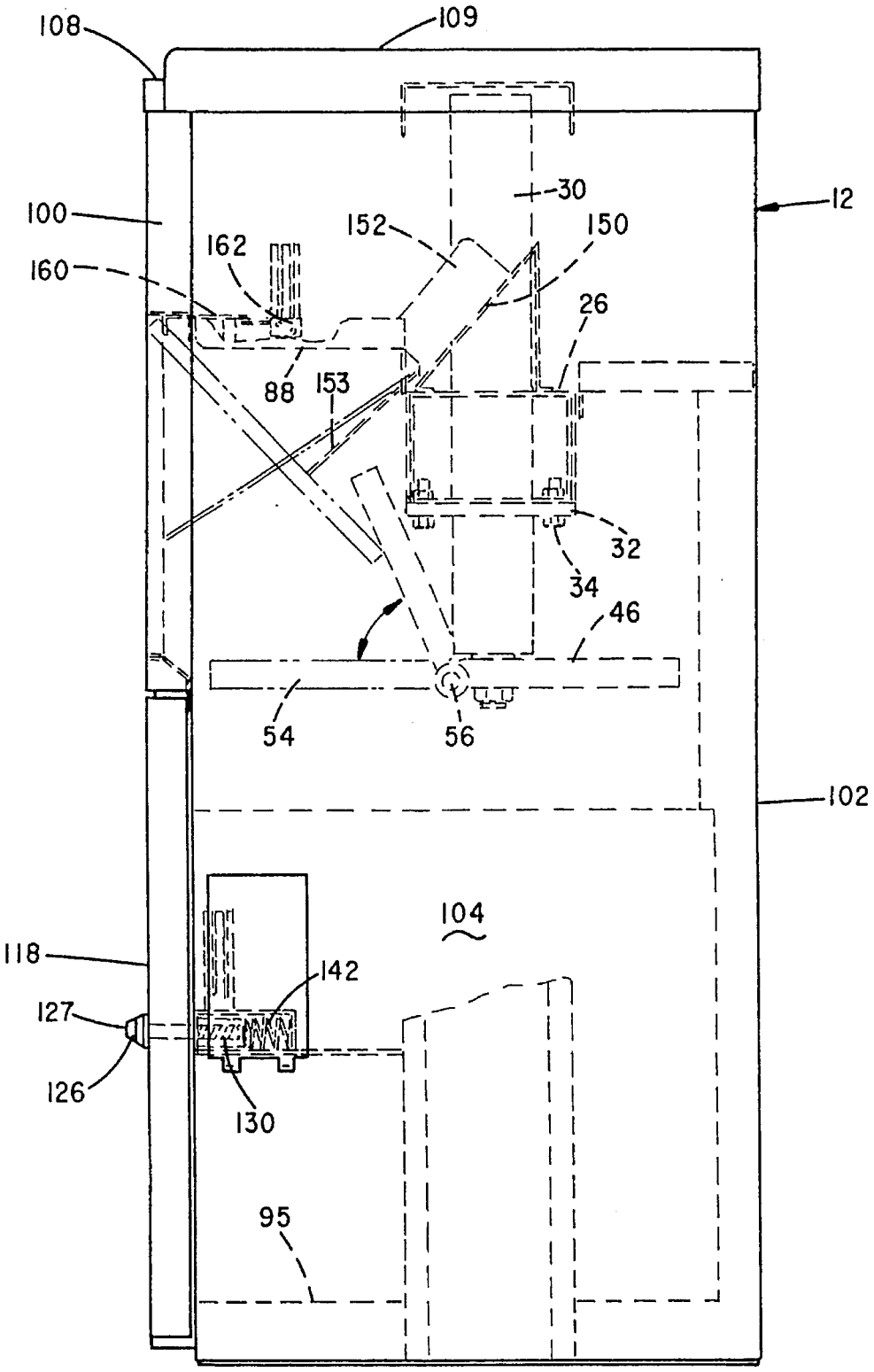
FIG. 3 is a side elevational view of the cabinet of the present invention showing the relationship between the folding compaction plate assembly and the refuse entry door when the compaction plate is in its folded disposition.

Referring momentarily to FIGS. 2 and 3, the cross arm member 26 serves as a support for a hydraulic ram 30. In particular, the hydraulic ram 30 is affixed to a mounting plate 32 which, in turn, is secured by four bolts 34 to the underside of the cross arm 26. Likewise, tubular bearings 36 and 38 pass vertically through and are welded to the cross arm 26 and serve as sleeve bearings for a pair of compaction plate guide rods 40 and 42.

Figure 4:
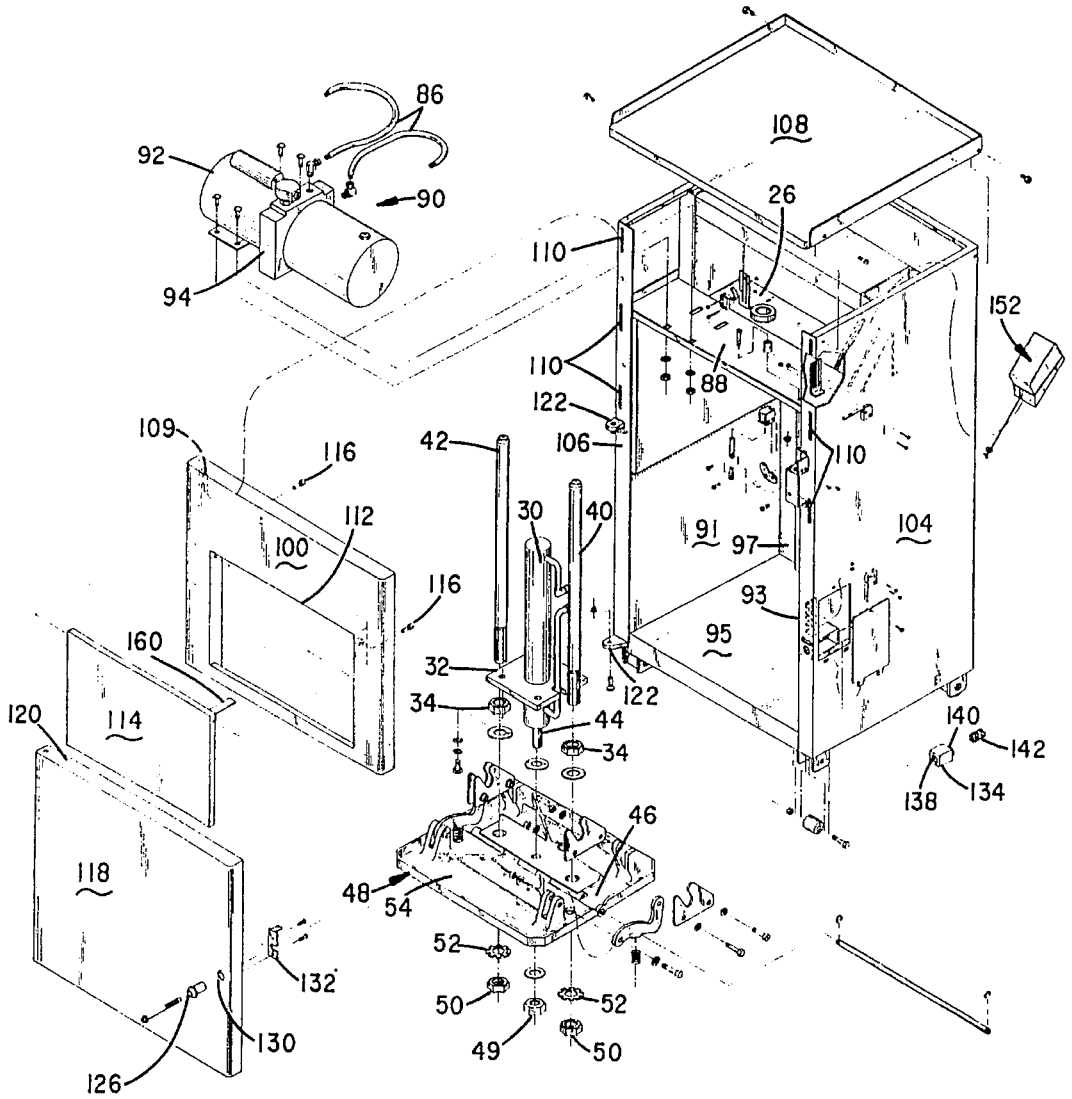
FIG. 4 is an exploded perspective view of the preferred embodiment.

Referring now to FIG. 2 and the blown-apart view of FIG. 4, the hydraulic ram 30 has a piston rod 44 which bolts to a fixed horizontal segment 46 of a two-piece compaction plate assembly that is indicated generally numeral 48. The guide rods 40 and 42, likewise, are bolted to the fixed horizontal segment 46 of the compaction plate assembly 48 by means of nuts 50 and lock washers 52. They cooperate with the threaded ends of the guide rods 40 and 42. In FIGS. 1 through 4, a moveable segment of the two-piece compaction plate assembly 48 is identified by numeral 54 and is shown as being hinged to the fixed portion 46 by a hinge pin 56 which passes through aligned bores formed in regularly spaced tubular hinge projections that extend along the mating edges of the fixed compaction plate segment 46 and the moveable one 54.

Figure 5:
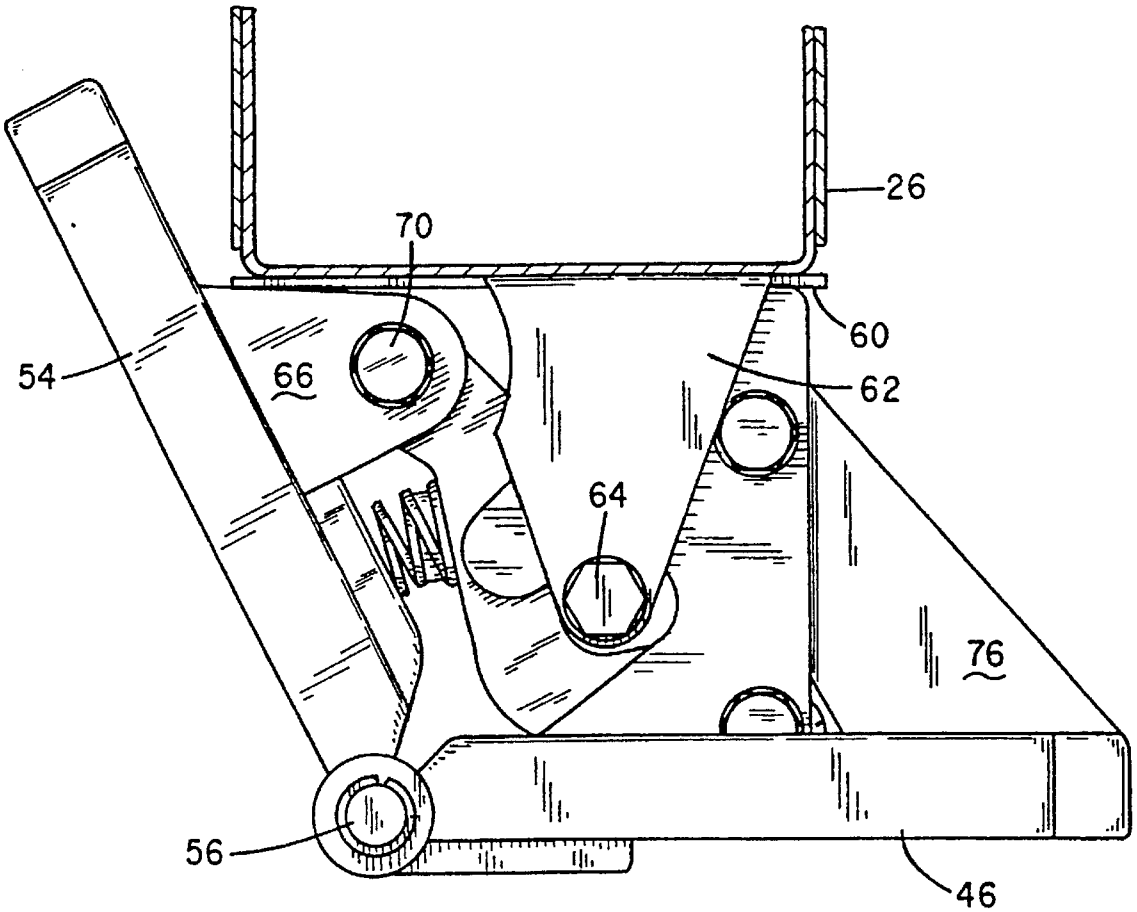
FIG. 5 is a side view of the compaction plate assembly 48 in its folded disposition.
Figure 6:
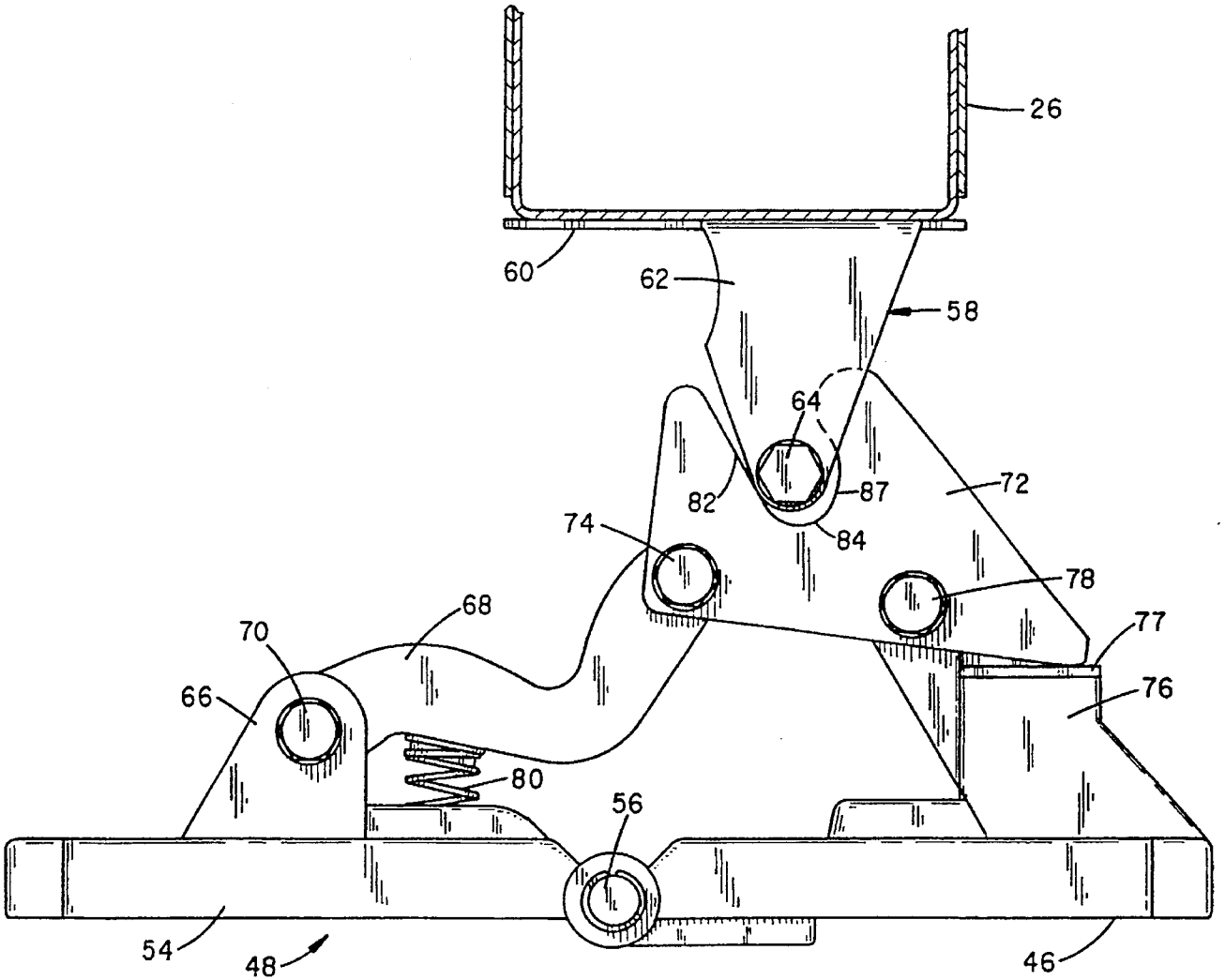
FIG. 6 is a side elevation of the compaction plate assembly in its flat or planar position.
Figure 7:
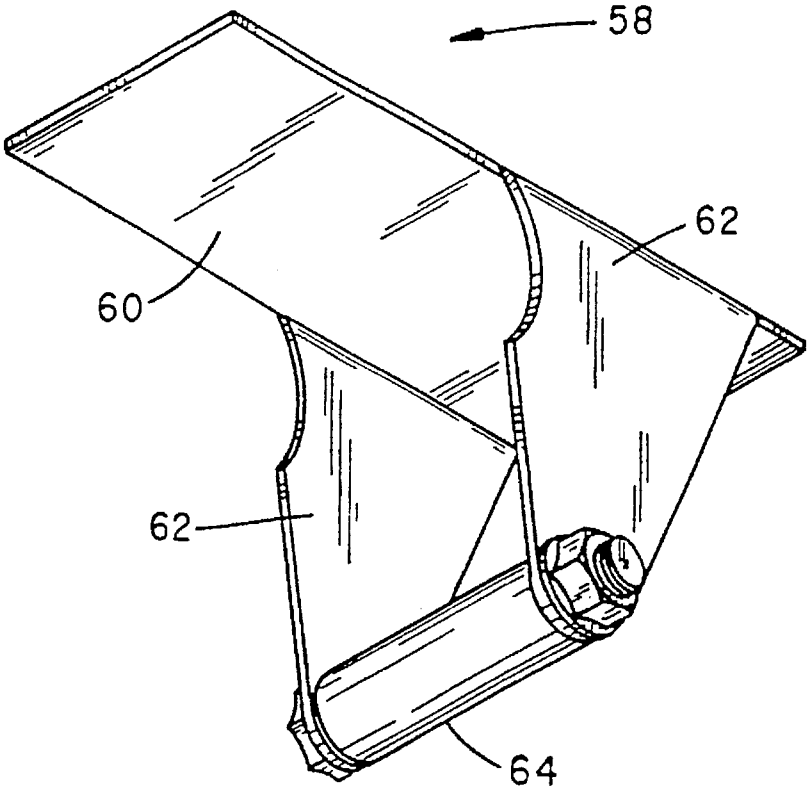
FIG. 7 is a perspective view of the cam follower assembly used in the compactor of the present invention.

FIG. 5 is a side elevation view of the compaction plate in its folded condition, and FIG. 6 is a similar view of the compaction plate in its flat or planar condition. In these figures, the cross arm 26 is shown as having welded, or otherwise affixed to it proximate the opposed ends thereof, a pair of cam follower members as at 58. A perspective view of the cam followers is illustrated in FIG. 7. They each comprise a flat plate 60 that is welded or otherwise affixed to the bottom surface of the cross arm 26, one proximate each end, and depending downwardly from the plate 60 are a pair of parallel, spaced-apart arms 62 between which is journaled a cam roller, as at 64.

With reference again to FIGS. 5 and 6, integrally cast as part of the moveable compaction plate segment 54 are a pair of side-by-side bosses as at 66 between which is pivotally joined a first linkage 68. That is to say, the bosses 66 form a part of a clevis coupling and include a bore for receiving a clevis pin 70 that also passes through a bore formed in the end portion of a linkage member 68. The opposite end of the linkage 68 is likewise hinged, via a clevis coupling, to a pair of parallel spaced-apart cam plates 72 by means of a clevis pin 74. The stationary segment 46 of the compaction plate assembly 48 also includes a pair of bosses 76, one proximate the opposed side edges of the compaction plate 46. The bosses 76 are dimensioned to fit between the pair of spaced-apart cam plates 72, and a clevis pin 78 is inserted through aligned bores formed in the cam plates and the associated boss to create a pivot joint therebetween. A horseshoe-sharpen plate 77 is fastened atop the pair of bosses 76 and is engaged by the tail-end portion of the cam plates 72 preventing undue wear on the casting comprising the stationary compaction plate portion 46. Completing the compaction plate assembly are a pair of coiled compression springs 80 positioned between the movable plate segment and the linkages 68.

The pair of cam plates 72 each include an inclined notch for receiving the cam follower roller 64 therein as the compaction plate approaches the top of its stroke. The notch 82 includes an inwardly extending linear segment that joins an arcuate segment 84 defining a concave caming surface 87. As will be explained in greater detail when the operation of the present invention is set forth, the shape of the notch 82 is important to the manner in which the compaction plate is made to fold and unfold during actuation of the hydraulic ram 40 as the compaction plate moves through its stroke from an elevated position to its lower refuse compacting position and back again.

Referring once more to FIGS. 1 and 4, a tray member 88 can be seen and it extends substantially the entire width dimension of the cabinet 12. This tray is designed to support and hold a hydraulic power assembly 90 comprising an electric motor 92 coupled in driving relationship to a hydraulic pump 94 which is operatively coupled by hydraulic hoses 86 to the hydraulic ram 40. With no limitation intended, the electric motor may comprise a one-half horsepower 60 cycle 115 volt capacitor start motor driving the hydraulic pump 94.

As is best seen in the blown-apart view of FIG. 4, the cabinet 12 includes left and right inner side walls 91 and 93, a floor 95 and a rear wall 97 defining a compaction chamber. The walls 91, 93 and 97 are recessed relative to the corresponding interior walls defining an upper refuse entry chamber. This recess allows the upper edges of a refuse receiving box or receptacle 144 to be flush with the walls of the upper chamber and not in the path of travel of the compaction plate as it moves into the receptacle to crush the refuse deposited therein.

Enclosing the structural frame and the working parts of the compactor 10 are front and rear exterior skins 100 and 102, exterior side skins 104 and 106 and a top member 108 which has a flange 109 extending around the two sides and rear thereof. The front skin 100 includes hook members as at 109 in the rear face thereof for engaging vertical slots, as at 110 in FIG. 3, for holding the skinned panel 100 to the framework. Formed through the skin panel 100 is a trash receiving opening 112 in which is fitted an access door 114. The access door 114 is hinged along its upper horizontal edge 116 to the decorative skin panel 100 by hinge pins 116 (FIG. 4).

Disposed below the panel 100 is a trash removal door 118 which is hinged to swing about a vertical access disposed along the left edge 120 thereof between ears 122 projecting outwardly from the left side wall 106 of the cabinet. A lock assembly for the trash removal door is indicated generally by numeral 124 (FIG. 1). It comprises a decorative tubular bezel 126 which is frustoconical in shape. Extending rearward from the bezel is a cylindrical segment 128 dimensioned to span the thickness dimension of the door through which it passes. Extending through the tubular bezel is a screw 127 having an aperture in a front face thereof for receiving a tool, such as an Allen wrench therein. The screw 127 terminates in a threaded shank 130. The lock assembly thus far described is held in place in the door by a plate 132 (FIG. 4) having a U-shaped notch formed laterally therein, the notch being dimensioned to receive a grooved portion of the shank 130. The plate 132 is adapted to be affixed by screws to the rear face of the door 118 with the threaded shank portion 130 projecting outwardly from that rear face. Mounted within the cabinet is a block 134 having a threaded bore 136 extending through it. The bore preferably has a counter sunk front face as at 138 and a cylindrical boss 140 projecting from its rear face. The boss 140 cooperates with a helical spring as at 142 which abuts a fixed support member. By this means, the block 134 is able to float slightly in all directions and because of the counter sunk opening 138 in the face of the block, tends to self-center on the threaded shank 130. By rotating the shank 130 within the cylindrical sleeve 128, the refuse removal door 118 can be locked during use of the refuse compactor, but periodically opened to gain access to the removable container 144, which is adapted to fit within the confines of the cabinet behind the refuse removal door 118. The refuse removal door 118 is also provided with an electrical interlock in the form of a "kill" switch which removes power from the electric motor any time that the door 118 begins to open as the screw lock assembly is released. This precludes accidental injury through actuation of the compaction plate when the door 118 is open.

Referring again to FIGS. 1 and 3, there is shown attached to the upper surface of the cross arm 26, proximate the right end thereof, an angle plate 150 on which is mounted a door opening motor assembly 152. This motor assembly may comprise the device described in U.S. Pat. No. 4,609,122 and available through KZCO, Inc. of Ashland, Nebr. However, limitation to this particular device is not intended. It includes an electric motor (not shown) contained within the box 151 that is coupled to a reel and wrapped about the reel is a cord or string 153 whose free end is passed through a keyhole opening 154 formed in the rear surface panel of the refuse deposit door 114, all is shown in FIG. 1. When a slight inward movement of the door is effected by a patron preparing to deposit trash, the motor assembly 152 takes over to pull the door fully open. After a short delay, it again allows the door to reclose.

As seen in FIG. 1, a solenoid actuated latch assembly 156 is mounted to the frame and includes a latch 158 which can be made to move under control of a solenoid to a position to block the opening of the refuse access door 114 at all times that the compaction plate is being cycled to move between its uppermost disposition and its lower trash compacting disposition. Only when the compaction plate is at rest in its elevated position will the latch 158 be out of blocking engagement with the door 114.

Figure 8:
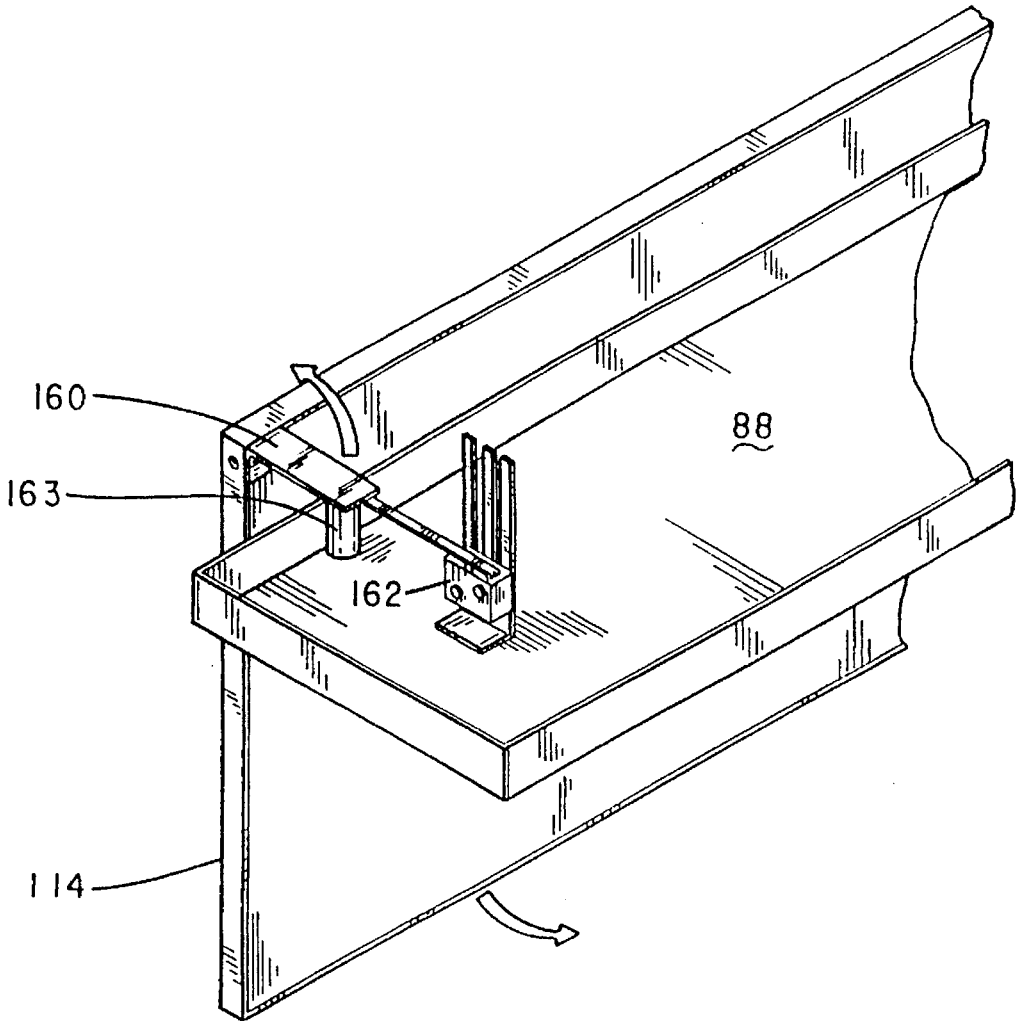
FIG. 8 is a partial perspective view of the refuse entry door and a control switch used therewith.

Affixed to the upper edge of the refuse deposit door 114 is a finger or tab 160 (FIGS. 1 and 8) that cooperates with a Microswitch® 162 that is positioned on the support shelf 88. The Microswitch® 162 is connected in circuit with a counter implemented in the microcontroller 164 (FIG. 1). After a preprogrammed number of opening and closing cycles of the door, the microcontroller will issue a command to the motor 92 to cause the compaction plate to cycle. Thus, it is only after a certain amount of refuse has been deposited that a compaction stroke will occur. Cooperating with the finger 160 is a permanent magnet 163 fixedly mounted on the equipment shelf 88. The attraction of the finger 160 to the magnet 163 as the door 114 assumes it closed position limits unwanted oscillation or swinging of the door.

OPERATION

As was mentioned in the introductory portion of the specification, the refuse compactor of the present invention is especially designed for use in fast food restaurants and would typically be placed near the exit door where patrons would be expected to deposit their refuse from a serving tray and then place that serving tray atop the cover 108 of the compactor which serves as a storage rack. After a preprogrammed number of opening and closing cycles of the refuse deposit door 114, the microprocessor will cause the electric motor and hydraulic pump to be actuated to thereby cycle the compaction plate, causing it to move between its elevated position downward to compress the deposited refuse into the container 144. Referring to FIGS. 5 and 6, as the compaction plate assembly 48 is driven downward from its uppermost position, the engagement between the cam follower roller 64 and the arcuate segment 84 and the concave caming surface 87 of the cam plate 72 causes the cam plate 72 to be momentarily hooked and held as the compaction plate assembly begins its downward movement. Through linkage 68, the movable segment 54 of the compaction plate assembly will be caused to rotate about hinge pin 56, causing it to push down on any trash that may be present, until an over-center latching action takes place wherein the bottom surfaces of the fixed segment of the compaction plate 46 and the moveable segment 54 are locked in their coplanar orientation. As the compaction plate assembly is driven downward into the receptacle 144, the refuse contained therein is compressed under high forces provided by the hydraulic ram and upon reaching its lowermost position, the compaction plate rests momentarily for a time period determined by the microcontroller 164, thereby allowing the refuse to take on a permanent set that prevents significant rebound or reexpansion once the compaction plate again begins to rise.

Once the compaction plate begins to rise, a point will be reached as illustrated in FIG. 6 wherein the cam follower plate 72 will again engage the cam follower roller 64, thereby pressing downward on the cam plate 72 and overcoming the force exerted by the compression spring 80 against the linkage 68. This drives the linkage 68 out of its over-center position and as the cam plate 72 is made to rotate counterclockwise about clevis pin 78, the linkage arm 68 is rotated clockwise about clevis pin 70 and the movable segment 54 of the compaction plate is made to rotate to the disposition shown in FIG. 5.

It is because the two-piece compaction plate assembly is able to fold to the disposition shown in FIG. 1 that allows the compactor cabinet to be only four feet high while still allowing trash to be deposited at a level below the compaction plate and into a receptacle 144 of a practical size. With the compaction plate folded, the refuse deposit door 114 can be swung inward by approximately 65°, thereby allowing the refuse to be deposited at a level that is below the compaction plate. Because of the close cooperation of the access door 114 with the upturned segment 54 of the compaction plate when it is in its elevated position, patrons are unable to deposit any refuse atop the compaction plate, either by accident or intentionally. Moreover, because of the solenoid interlock 156, a patron cannot open the door 114 at a time that the compaction plate is cycling and is therefore protected from injury. If the compaction plate were unable to fold in the manner described, it would be necessary to have a substantially taller cabinet, making it impractical for fast food restaurant applications.

Another feature of the present invention is that the microcontroller 164 includes a semiconductor voice chip that allows recorded messages to be periodically played through a speaker 165 (FIG. 1). The messages conveyed are arbitrary, but may include instructions in one or more languages concerning how restaurant employees are to effect removal of a filled container 144. Messages may also comprise public service announcements for the local community or simply a thank you for patronizing the restaurant. The microcontroller again senses the actuation of the refuse entry door and initiates the voice message.

The microprocessor is also coupled to a Microswitch 167 (FIG. 2) which cooperates with the guide rod 38 and which detects when the level of the compacted refuse is such that the container 144 should be removed and replaced. The microprocessor then may cause an audible or visual indication to be generated for informing restaurant employees that it is now time to empty the refuse container 144. The Microswitch 167 has a roller that cooperates with the upper end of the guide rod 38. When the container 144 is empty, the guide rod descends to the point where the guide rod does not effect closure of the switch and then on its return stroke, the switch again closes. This off-on switch cycle continues until the level of refuse will not permit the descent of the guide rod to an extent that it will allow the switch to open. The condition is sensed by the microprocessor and it generates the "container-full" indication.

Without limitation, the microcontroller 164 may comprise a Micro-1® microprogrammable controller available from the Idec Corporation of Sunnyvale, Calif. This device is well suited for small machine control applications and can be readily used to replace more conventional relay control circuits commonly used in trash compacting equipment. The device is readily programmable using a small, hand-held program loader. It includes EEPROM memory for storing user programs without the need for a back-up power supply. The device includes I/O indicators which proves valuable in trouble shooting operation of the equipment.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A refuse compactor comprising:

(a) a cabinet having a refuse entry door swingably mounted therein for pivotable movement to an open position about a first horizontal axis;

(b) a reciprocally moveable compaction plate disposed in said cabinet for vertical movement between an elevated position proximate said refuse entry door to a refuse compacting position located below said refuse entry door, said compaction plate comprising first and second planar segments hinged together about a second horizontal axis;

(c) means for moving said compaction plate between said first elevated position and said refuse compacting position; and (d) a cam-actuated over-center latching device affixed to said compaction plate and a stationary mounted cam follower disposed in the path of travel of the over-center latching device for folding said first and second planar segments comprising said compaction plate to a planar configuration as said compaction plate moves from its elevated position to its refuse compacting position and to an angle configuration as said compaction plate moves from its refuse compacting position to its elevated position.

2. The refuse compactor as in claim 1 wherein said refuse entry door can be swung inwardly for depositing refuse into the cabinet without engaging said first planar segment of the compaction plate when said first planar segment is in the angled configuration.

3. The refuse compactor as in claim 2 and further including latch means operatively disposed relative to said refuse entry door for preventing opening of said refuse entry door when said compaction plate is in other than said elevated position.

4. The refuse compactor as in claim 3 wherein said latch means is solenoid actuated.

5. The refuse compactor as in claim 1 wherein said over-center latching device comprises:

a first linkage pivotally coupled at a first end to the first planar segment, a second linkage pivotally coupled at a first end to a second end of the first linkage and pivotally coupled at a second end to the second planar segment, said second linkage including a cam surface engageable by said cam follower; and means for biasing said first linkage to an over-center latch disposition when said cam surface is disengaged from said cam follower.

6. The refuse compactor as in claim 1 wherein the means for moving the compaction plate comprises:

a hydraulic cylinder operatively coupled to a cabinet frame member and to said second planar segment of said compaction plate, a hydraulic pump for supplying hydraulic fluid under pressure to said hydraulic cylinder and an electric motor driving said hydraulic pump.

7. A refuse compactor comprising, in combination:

(a) a cabinet including a rectangular base member, first and second vertically extending side frame members affixed to said base member proximate opposed sides thereof, a top frame member extending between said first and second side frame members, and a rigid cross-arm member affixed to and extending between said first and second side frame members below said top frame member;

(b) an inner compaction chamber defined by a vertically extending rear wall and two vertically extending side walls joined to said rear wall at right angles;

(c) an inner refuse entry chamber disposed above said inner compaction chamber defined by a vertically extending rear wall and two vertically extending side walls joined to said rear wall of said refuse entry chamber, where the rear wall and two side walls of the compaction chamber are recessed relative to the rear and two side walls of the refuse entry chamber, said cross arm member extending laterally across said refuse entry chamber;

(d) a hydraulic ram affixed to said cross arm member proximate the center thereof, said hydraulic ram including a vertically extending piston rod;

(e) an electric motor driven hydraulic pump for selectively applying hydraulic fluid under pressure to the hydraulic ram;

(f) a two-segment compaction plate having a first segment affixed to the piston rod for reciprocal movement therewith and a second segment connected by a hinge to the first segment; and (g) means including a cam-actuated over-center latching device affixed between the two segments of the two-segment compaction plate for maintaining said first and second compaction plate segments locked in coplanar relationship during movement between an elevated disposition in the refuse entry chamber and a lower refuse compacting disposition in the compaction chamber and a stationary mounted cam follower disposed in the path of travel of the over-center latching device for locking said second segment at a predetermined angle to the first segment when the compaction plate rises to an uppermost elevated disposition.

8. The refuse compactor as in claim 7 and further including a refuse take-out door hinged to a front of the refuse compacting chamber.

9. The refuse compactor as in claim 8 wherein the refuse take-out door includes a screw-lock for maintaining the refuse take-out door closed against a vertical edge of the vertically extending side walls of the inner compaction chamber.

10. The refuse compactor as in claim 9 wherein the screw-lock comprises a tubular sleeve extending through a thickness dimension of the take-out door; a cylindrical rod extending through the tubular sleeve and rotatable therein, the cylindrical rod having a threaded surface over a predetermined length thereof; and a block having an internally threaded bore for mating with the thread surface of the cylindrical rod, the block being resiliently supported relative to a vertical edge of one of the two side walls of the compaction chamber.

11. The refuse compactor as in claim 7 wherein said cross-arm member includes a pair of sleeve bearings disposed vertically therein on opposed sides of the hydraulic ram; a pair of cylindrical guide rods extending through said pair of sleeve bearings, with the lower end of each guide rod affixed to the first segment of the compaction plate.

12. The refuse compactor as in claim 7 wherein the over-center latching device comprises a pair of linkage members pivotally joined to one another and to respective bosses on the first and second segments of the compaction plate, and means for biasing the first and second linkage members so that the pivot joint between them is in an over-center disposition relative to an imaginary line passing through the pivot joints between the pair of linkage members and said bosses.

13. The refuse compactor as in claim 12 wherein one of the pair of linkage members includes a cam slot including a concave arcuate segment.

14. The refuse compactor as in claim 13 wherein said cam follower is affixed to the cross-arm member and cooperates with the cam slot when the compaction plate rises to its uppermost position to effect the locking of the second segment of the compaction plate at the predetermined angle, the concave arcuate segment of the cam slot cooperating with the cam follower as the compaction plate leaves the uppermost position to unfold the compaction plate and latch the first and second segments in the coplanar relationship.

15. The refuse compactor as in claim 7 and further including a refuse entry door pivotally mounted on a horizontal axis proximate a door opening in a panel positioned in front of the refuse entry chamber, the refuse entry door being swingable inwardly to allow deposit of refuse through the refuse entry door into the compaction chamber.

16. The refuse compactor as in claim 15 wherein said entry door, when open, extends parallel to the second segment of the compaction plate when the second segment is at the predetermined angle to the first segment.

17. The refuse compactor as in claim 15 and further including means for automatically completely opening the refuse entry door upon its being only slightly touched and displaced from a closed disposition.

18. The refuse compactor as in claim 17 wherein the means for automatically opening the refuse entry door comprises:

(a) an electric motor driven reel having a flexible cord deployed thereon, a free end of the cord being secured to the refuse entry door; and (b) a door movement sensor operatively disposed relative to a lower edge of the refuse entry door and connected in circuit with the electric motor driven reel for energizing the electric motor driven reel when the refuse entry door is slightly displaced.

19. The refuse compactor as in claim 15 and further including means responsive to actuation of the refuse entry door for generating audible messages.

20. The refuse compactor as in claim 19 wherein the means for providing audible messages comprises a speaker disposed in said refuse entry chamber, amplifier means for driving said speaker and a voice-type integrated circuit chip for storing prerecorded voice messages and replaying the voice messages operatively coupled to the amplifier means.

21. The refuse compactor as in claim 15 and further including:

(a) a refuse entry door locking mechanism for preventing the opening of the refuse entry door when the motor driven hydraulic pump is being driven.

22. The refuse compactor as in claim 21 wherein the refuse entry door locking mechanism comprises an electrical solenoid actuated latch moveable between an extended and a retracted disposition, the latch blocking opening of the refuse entry door when in its extended disposition.

* * * * *